US006483034B1

(12) United States Patent
Sasagawa et al.

(10) Patent No.: US 6,483,034 B1
(45) Date of Patent: Nov. 19, 2002

(54) BLADE

(75) Inventors: Gouki Sasagawa, Kanagawa (JP); Masato Ogasawara, Tokyo (JP)

(73) Assignees: Hokushin Corporation, Kanagawa (JP); Toshiba Tec Kabushiki Kaisha, Tokyo (JP); Kabushiki Kaisha Toshiba, Kanagawa (JP)

( * ) Notice: Subject to any disclaimer, the term of this patent is extended or adjusted under 35 U.S.C. 154(b) by 0 days.

(21) Appl. No.: 09/484,694

(22) Filed: Jan. 18, 2000

(30) Foreign Application Priority Data

Jan. 21, 1999 (JP) ..... 11-013322

(51) Int. Cl.[7] ..... H01R 4/00
(52) U.S. Cl. ..... 174/84 R
(58) Field of Search ..... 174/84 R, 74 R; 399/174; 355/299, 302, 15; 430/58, 128, 132; 428/332

(56) References Cited

U.S. PATENT DOCUMENTS 4,083,633 A * 4/1978 Shanly ..... 355/15
4,334,766 A * 6/1982 Sugiyama et al. ..... 355/15
4,639,123 A * 1/1987 Adachi et al. ..... 355/15
4,939,551 A * 7/1990 Hashiyama et al. ..... 355/299
5,122,429 A * 6/1992 Sundararajan et al. ..... 430/58
5,139,909 A * 8/1992 Kazmaier et al. ..... 430/59
5,166,018 A * 11/1992 Iino et al. ..... 430/58
5,371,577 A * 12/1994 Fujimura et al. ..... 355/215
5,550,617 A * 8/1996 Odagawa et al. ..... 355/210
5,595,845 A * 1/1997 Maeda et al. ..... 430/58
5,749,030 A 5/1998 Park ..... 399/148
5,839,029 A * 11/1998 Kataoka et al. ..... 399/115
5,842,087 A * 11/1998 Matsushita et al. ..... 399/174
5,870,657 A * 2/1999 Nagame et al. ..... 399/174
5,875,375 A * 2/1999 Ohmori et al. ..... 399/159
5,999,773 A * 12/1999 Yasutomi et al. ..... 399/148
6,215,969 B1 * 4/2001 Nomura et al. ..... 399/111

FOREIGN PATENT DOCUMENTS

JP 3-75139 A * 8/1989 ..... B32B/15/08
JP 07129053 A * 5/1995 ..... G03G/21/10
JP 09174742 A * 7/1997 ..... B32B/7/04

* cited by examiner

*Primary Examiner*—Dean A. Reichard
*Assistant Examiner*—William H. Mayo, III
(74) *Attorney, Agent, or Firm*—Sughrue Mion, PLLC

(57) ABSTRACT

A blade has a rubber blade member and a holder. One widthwise end portion of the blade member is brought into sliding contact with a subject member. The holder is bonded to the other widthwise end portion of the blade member via an adhesive layer. The holder extends in the longitudinal direction of the blade. Conductive paste is applied to at least a portion of an externally exposed end surface of the adhesive layer between the blade member and the holder.

16 Claims, 10 Drawing Sheets

BLADE

BACKGROUND OF THE INVENTION

1. Field of the Invention

The present invention relates to a blade, and more particularly to a blade for establishing charges on, eliminating charges from, or cleaning an electrophotosensitive member, a transfer drum or transfer belt used in a transfer process, an intermediate transport belt, as well as a blade for smoothing charges on, eliminating charges from, or establishing charges on a developing blade used in a developing process, among others.

2. Description of the Related Art

Among chargers, there have been known corona chargers utilizing corona discharge and contact chargers. In a corona charger, since a high voltage of 4–8 kV must be applied to a wire, the wire and the case that surrounds the wire must be isolated from each other in order to prevent current leakage from the wire to the case. Thus, the corona charger has a drawback in that it is large. Also, since most discharge current flows to the case, a large magnitude of discharge is required in order to supply a required amount of current to an electrophotosensitive member. As a result, a large amount of ozone is generated, causing oxidation of apparatus components and deterioration of the surface of the electrophotosensitive member. Also, such ozone may be harmful to the human body.

In view of such drawbacks of corona chargers, contact chargers have been replacing corona chargers.

In contrast to the corona charger, the contact charger can charge, for example, an electrophotosensitive member at low voltage, thereby enabling implementation of a compact electrostatographic apparatus. The amount of generated ozone is 1/10 to 1/100 to that the corona charger. The contact charger is implemented as a conductive brush, a single-layer roller, a multilayer roller, or a blade, among other forms.

In the case of a brush-type charger employing a conductive brush of, for example, rayon fibers that contain carbon, combings are unavoidable, causing current leakage to other chargers. Also, bristles of the brush fan out with use, potentially causing current leakage to a peripheral element. Charging tends to become nonuniform, causing minute ruggedness in electric potential on the surface of an electrophotosensitive member and resulting in formation of white or black lines on an image.

A single-layer blade member involves a problem in that applied voltage leaks to any scratch present on an electrophotosensitive member. Since the resistance of the blade member depends sensitively on the amount of a conducting filler added to a base material, resistance control is difficult.

In the case of a multilayer blade member, such as a roller covered with a tube, the structure is complex with a resultant increase in cost.

In the case of a blade member such as a blade including a conductive base material and an insulating layer applied or bonded to the base material, when the insulating layer wears, the conductive base material may be exposed or may exfoliate. In the case of a blade including an insulative base material and a conductive layer applied to the insulative base material, the conductive layer may exfoliate. Also, cost increases as compared to the case of a single-body structure.

When a rubber blade is bonded to a metallic holder by use of a hydrophilic adhesive, rust is produced at the location where the rubber blade is bonded to the metallic holder, due to moisture in the air, so that the bonding strength decreases.

Especially, when a rubber blade containing an ion-conductive filler is used, rust is easily produced at the location where the rubber blade is bonded to the metallic holder, so that the bonding strength decreases.

Further, in the case of a blade having an insulating surface layer, a sufficient degree of electrical conduction cannot be established between a power source and an electrophotosensitive member, so that the operation for establishing charges on and eliminating charges from the electrophotosensitive member cannot be performed sufficiently.

SUMMARY OF THE INVENTION

In view of the foregoing, an object of the present invention is to provide a blade in which the adhesive connection between a rubber blade and a holder is maintained for a long period of time; in which reliable electrical conduction with a power source can be established if the rubber blade is electrically conductive; and which enables a reliable operation for establishing charges on and eliminating charges from a member to be charged such as an electrophotosensitive member.

To achieve the above object, according to the first aspect of the present invention, there is provided a blade which comprises a blade member whose one widthwise end portion is brought into sliding contact with a subject member; and a holder bonded to the other widthwise end portion of the blade member via an adhesive layer and extending in the longitudinal direction of the blade member, wherein at least a portion of an externally exposed end surface of the adhesive layer is subjected to waterproofing treatment.

Preferably, the widthwise end portion of the blade member opposite the widthwise end portion which comes into contact with the subject member is subjected to waterproofing treatment.

Preferably, the waterproofing treatment is application of a hydrophobic paint.

Preferably, at least a portion of the adhesive used for bonding the blade member to the holder is hydrophilic.

Preferably, the blade member has electrical conductivity, and comprises a base material and an insoluble conducting filler dispersed in the base material. The insoluble conducting filler is selected from the group consisting of carbon black and metal powder.

Preferably, the blade member further contains an ion-conductive filler.

Preferably, the blade member is formed in a single body by use of the base material; one thicknesswise end portion of the blade member, which comes into contact with the subject member, does not substantially contain the insoluble conducting filler; and the other thicknesswise end portion of the blade member contains the insoluble conducting filler.

Preferably, a conductive binder containing at least a hydrophobic binder and an insoluble conducting filler dispersed therein is applied such that connection is established between the holder and at least a portion of the widthwise end portion of the blade member opposite the widthwise end portion which comes into contact with the subject member.

Preferably, the volume resistance $\rho v$ of one thicknesswise end portion of the blade member which comes into contact with the subject member and the surface resistance $\rho s$ of the opposite thicknesswise end of the blade member satisfy the relationship $\rho s \cdot L < \rho v \cdot d/L$, where L is the distance between the end where the conductive binder is applied and the end which comes into contact with the subject member, and d is the thickness of the blade member.

Preferably, the surface resistance of the thicknesswise end portion of the blade member opposite the thicknesswise end portion which comes into contact with the subject member is adjusted through adjustment of grain size distribution of the insoluble conducting filler contained in the blade member.

Preferably, the surface resistance of the thicknesswise end portion of the blade member opposite the thicknesswise end portion which comes into contact with the subject member is $10^7$ Ω□ or less.

Preferably, the blade member is formed of an insulating or semi-conductive polymeric base material.

Preferably, the blade contains an ion-conductive filler, and a layer for intercepting ions is provided between the blade member and the holder.

According to another aspect of the present invention, there is provided a blade which comprises a blade member whose one widthwise end portion is brought into sliding contact with a subject member; and a holder bonded to the other widthwise end portion of the blade member via an adhesive layer and extending in the longitudinal direction of the blade member, wherein the blade contains an ion-conductive filler; and a layer for intercepting ions is provided between the blade member and the holder.

In the blade according to the present invention, since the adhesive layer between the blade member and the holder is subjected to waterproofing treatment, the strength of the adhesive for bonding the blade member and the holder is reliably maintained for a long period of time.

The blade member according to the present invention provides advantageous effects in that the waterproofing treatment prevents a decrease in the bonding strength due to rust, and that the conductive paste or the like enables establishment of electrical conduction via the holder. Especially, the blade member assumes a single-body structure, and the portion of the blade member at which the blade member abuts a subject member (a member to be charged such as an electrophtosensitive member). Therefore, voltage leakage can be prevented to any scratch present on the subject member, and coming off of the conducting filler from the portion of the conducting member that abuts the subject member. Also, by controlling the thickness of the low-distribution-density portion, the electric resistance of the conducting member can be easily controlled. Through employment of the single-body structure, the fabrication process becomes simple, and fabrication costs reduce. Also, exfoliation of a component element is not involved. Through employment of the polymeric base material; particularly, liquid polyurethane, the blade member can be fabricated through centrifugal molding. Also, ooze of a plasticizer is not involved.

Through contact with the subject member, such as an electrophotosensitive member, the blade member of the present invention can smooth out charges on, eliminate charges from, or establish charges on the subject member. Also, a function other than an electrical one, such as a cleaning function, can be imparted to the blade member.

DESCRIPTION OF THE INVENTION AND PREFERRED EMBODIMENTS

The present invention will now be described in detail. In the case of a blade that abuts a member to be charged (hereinafter referred to as a "subject member"), such as an electrophotosensitive member, employment of an insulating layer formed on a portion of the blade member that abuts the subject member is known to prevent voltage leakage to a scratch on the subject member, which would otherwise occur when voltage is applied to the blade member. Such a voltage leak is effectively prevented through use of a blade which assumes a single-body structure and is formed of a polymeric base material. A portion of the blade that abuts the subject member contains a conducting filler of lower density than that of the remaining portion of the blade member, or contains substantially no conducting filler.

This technical solution is achieved on the basis of a finding that the electric resistance of the blade member depends on the thickness of the portion of the blade member in which the density of the conducting filler is low or substantially zero (hereinafter referred to as a "portion of low conducting-filler density"), and does not depend on the electric resistance of the portion in which the density of the conducting filler is high. In other words, the electric resistance of the blade member can be controlled by means of the thickness of the portion of low conducting-filler density. Thus, a blade member having a desired electric resistance can be fabricated easily. When the portion of low conducting-filler density is sufficiently high in electric resistance (for example, volume resistance is at least two orders of magnitude greater) in relation to the portion of high conducting-filler density, the electric resistance of the blade member depends on that of the portion of low conducting-filler density. Accordingly, the electric resistance of the blade member according to the invention is hardly influenced by the electric resistance of the portion of high conducting-filler density. Therefore, there is no need for strictly controlling the amount of the conducting filler to be added, and the electric resistance of the blade member can be easily controlled. Notably, the electric resistance of a conventional blade member is highly sensitive to the amount of a conducting filler contained in a base material, and is thus difficult to control.

In the above-described structure, a portion of low conducting-filler density abuts a subject member, such as an electrophotosensitive member, thereby utilizing the intrinsic endurance to wear possessed by an insulative base material. This feature prevents damage to a subject member, which would otherwise be caused by conducting filler particles that come off the blade member due to wear thereof. Further, employment of a single-body structure reduces costs and avoids exfoliation of a component member.

Figure 1A:
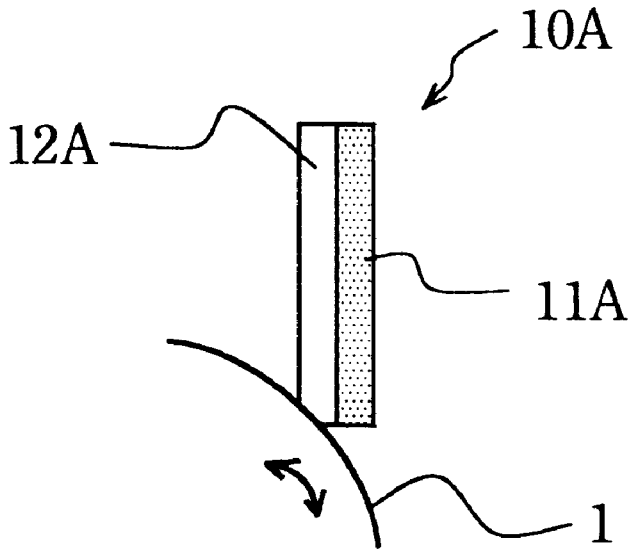
FIG. 1A is a view showing the exemplary shape of a blade member of the present invention.
Figure 1B:
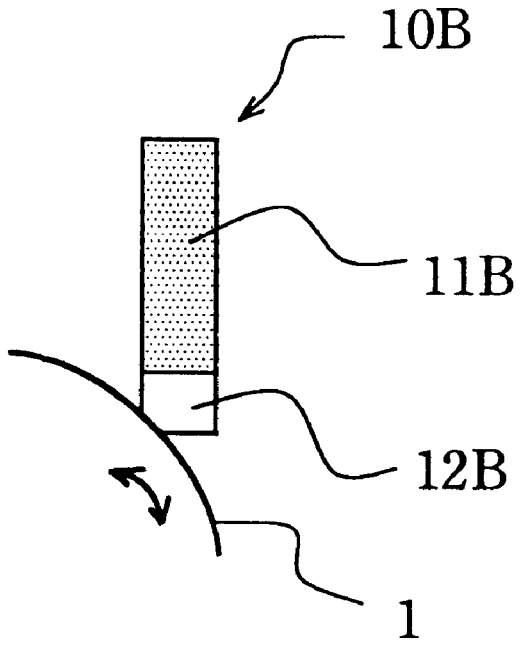
FIG. 1B is a view showing another exemplary shape of the blade member.

The blade of the present invention may be used in such a way that the blade member abuts a subject member in either "trail contact" (i.e., such that the end of the blade member faces in the same direction as that in which the subject member rotates) or "against contact" (i.e., such that the end of the blade member faces in the direction opposite that in which the subject member rotates). FIGS. 1A and 1B exemplify blade members of various shapes. The blade member 10A shown in FIG. 1A has a conductive portion 11A and a nonconductive portion 12A provided on one end surface thereof in the thicknesswise direction. No limitation is imposed on the state of contact of the blade member 10A, provided that the nonconductive portion 12A comes into contact with an electrophotosensitive member 1. The blade member 10 may abut the electrophotosensitive member 1 in trail contact in which the electrophotosensitive member 1 rotates clockwise or against contact in which the electrophotosensitive member 1 rotates counterclockwise.

The blade member 10B shown in FIG. 1B has a conductive portion 11B and a nonconductive portion 12B provided at one longitudinal end thereof. The blade member 10B is used in the same manner as that for the blade member 10A.

The conducting filler used in the blade member of the present invention is not particularly limited so long as it has electrical conductivity and is insoluble in a polymeric base material, such as rubber. Examples of such a conducting filler include carbon black and metal powder. Particularly, carbon black is relatively inexpensive and enables easy formation of a three-dimensional structure. Moreover, carbon black can develop electrical conductivity through addition of a smaller amount than can metal powder. Also, the electrical conductivity of carbon black is less sensitive to temperature and humidity. The kind of carbon black is not particularly limited. Specific examples of carbon black include KETJEN BLACK (trade name, product of Lion Corp.) and TOKA BLACK #5500 (trade name, product of Tokai Carbon Co., Ltd.).

Since carbon black or metal powder, when used as a conducting filler, develops electrical conductivity through direct contact among filler particles it must be contained in a relatively large amount thus potentially causing deterioration in the physical properties of a rubber member. By contrast, an ion-conductive filler can develop electrical conductivity through addition of a small amount and does not cause deterioration in the physical properties of a base material when added to the base material. Accordingly, when carbon black or metal powder used singly fails to develop sufficient electrical conductivity an ion-conductive filler may be added as an auxiliary filler. The ion-conductive filler is not particularly limited. Examples of such an ion-conductive filler include lithium perchlorate. A carbon black dispersant may be used as well. Examples of such a carbon black dispersant include DISPARON DA-703-50 (trade name, product of Kusumoto Kasei Co., Ltd.). Ion-conductive fillers and carbon black dispersants may be used singly or in combination.

When carbon black is used in combination with an ion-conductive filler or carbon black dispersant electrical conductivity can be developed in a smaller amount of addition than in the case where carbon black is used singly. As a result, the physical properties of a base material are not deteriorated, and the feature of carbon black that electrical conductivity is less sensitive to temperature and humidity can be imparted to the blade member. That is, in order to develop electrical conductivity carbon black may be used singly or in combination with an ion-conductive filler or carbon black dispersant.

A polymeric base material of the blade member may be a rigid material, so long as it is insulative or semiconductive. However, in order to establish reliable contact with a subject member, such as an electrophotosensitive member, the polymeric base material is preferably an elastic or flexible material. Examples of such an elastic material include elastomers, polyurethane, and silicone rubber and other rubber materials. Examples of such a flexible material include polyamide (PA), polyethylene terephthalate (PET), polyimide (PI), polyester, and other organic materials.

The polymeric base material must enable smooth dispersion of a conducting material. From this point of view, a liquid thermosetting elastomer, liquid polyurethane, or liquid silicone rubber is preferred as a polymeric base material.

Many rubber materials contain a plasticizer. Accordingly, when such a rubber material is left in contact with a subject member, the subject member may be contaminated with the plasticizer. In the case where the subject member is an electrophotosensitive member, polyurethane or silicone rubber is preferred as a polymeric base material. Notably, silicone rubber involves a drawback in that an oligomer may ooze out gradually. From this point of view, polyurethane is most preferred.

Among polyurethane materials injection-modable liquid polyurethane is particularly preferred. Such polyurethane can be obtained through thermally curing a mixture of high-molecular-weight polyol, an isocyanate compound, a chain extender, and a crosslinker, among others. Examples of polyol include polyester polyol, polycarbonate polyol, polyether polyol, and poly(carbonate-ether) polyol. Examples of an isocyanate compound include 4,4'-diphenyl methane diisocyanate (MDI), 2,6-toluene diisocyanate (TDI), 1,5-naphthalene diisocyanate (NDI), 3,3'-dimethyldiphenyl-4,4'-diisocyanate (TODI), and p-phenylene diisocyanate (PPDI). Examples of a chain extender include butanediol, ethylene glycol, trimethylolpropane, and polyvalent alcohol such as glycerin. Examples of a crosslinker include aromatic diamine crosslinkers.

No particular limitation is placed on a method for manufacturing a blade member in which the density of a conducting filler as measured at or in the vicinity of a portion that abuts a subject member, such as an electrophotosensitive member, is lower than that in the remaining portion, or substantially zero. However, centrifugal molding is preferred. When the true density of a conducting filler is rendered greater than the specific gravity of a base material the conducting filler sediments even in static molding. However, when the base material has high viscosity, the conducting filler has a large specific surface area, or when the setting speed of the base material is higher than the sedimentation velocity of the conducting filler, sedimentation of the conducting filler does not progress. Thus, there cannot be obtained a portion of the blade member where the conducting filler is distributed at a sufficiently low density. In such a case, centrifugal molding is preferred. The term "true density" means a volume density of particles having large projections and depressions, such as carbon black, as measured in a state in which all clearances have been eliminated and is not an apparent volume density of such particles.

According to centrifugal molding, a molding material is charged into a rotary drum of a centrifugal molding machine. Then, the drum is rotated at a predetermined speed for molding. Thus, sedimentation of the conducting filler is accelerated. Notably, a substrate layer for forming a mold face may be formed within the drum before a molding material is charged into the drum.

Figure 2:
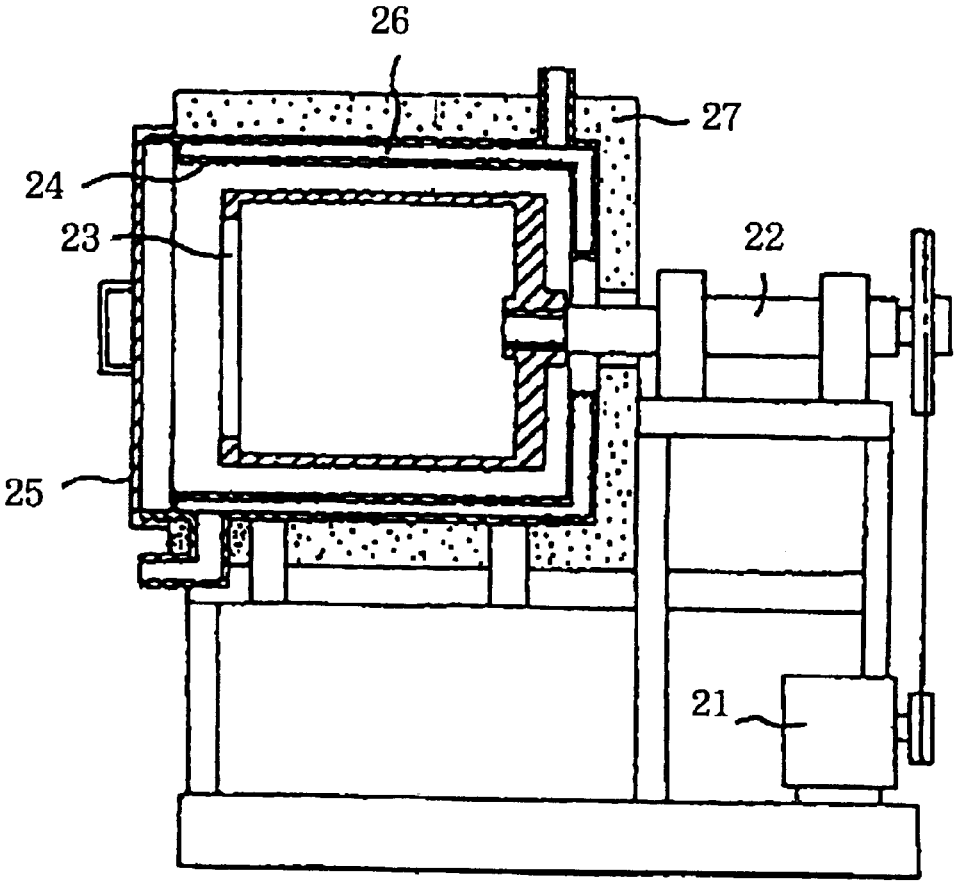
FIG. 2 is a view showing an apparatus for fabricating the blade member of the present invention.

FIG. 2 shows an example of a centrifugal molding apparatus. As shown in FIG. 2, the centrifugal molding apparatus includes a motor 21, a shaft 22 that is rotated by the motor 21, and a drum mold 23. One end of the shaft 22 is fixed to a central portion of the bottom of the drum mold 23. The drum mold 23 is held within a boxlike heating jacket 24. An opening of the heating jacket 24 is covered with a cover 25. A heating fluid passage 26, through which a heating fluid flows, surrounds the heating jacket 24. The heating fluid passage 26 is covered with a heat-insulating layer 27.

A mixture of a polymeric base material and carbon black serving as a conducting filler is charged into the drum mold 23. When the drum mold 23 is rotated, a centrifugal force is induced and promotes movement of the conducting filler, which has a high true density, toward the inner surface of the drum mold 23. Specifically, when the true density of the conducting filler is greater than the density of the base material, the conducting filler is distributed within the blade member molded within the drum mold 23 such that conducting-filler density increases toward the mold surface. In other words, the density of the conducting filler becomes sufficiently low or substantially zero at the open surface side of the blade member molded within the drum mold 23 (the surface of a blade member that is exposed to the atmosphere when the blade member rests within the drum mold is hereinafter referred to as an "open surface"). Accordingly, the thus-molded blade member is used in a charger such that the open-surface side abuts a subject member, such as an electrophotosensitive member.

Pits and projections on the surface of the drum mold 23 are impressed on the surface of the blade member that is in contact with the mold surface during molding. By contrast, the open surface is smooth and thus abuts a subject member reliably.

After rotation of the drum mold 23 is stopped the cylindrical molded blade member is cut in the axial direction yielding a blade member sheet. The sheet is aged as needed and is then cut such that the longitudinal direction of the final blade member corresponds to the circumferential direction of the cylindrical molded blade member, whereby the thickness of the final blade member becomes uniform. The thickness of the blade member can be controlled by means of controlling the amount of the molding material to be charged into the drum mold 23.

Alternatively, a molding material that contains a relatively large amount of a conducting filler is charged into the centrifugal molding machine to thereby form a first layer. While the first layer is semi-cured a molding material that contains a relatively small amount of the conducting filler or contains no conducting filler is charged into the molding machine thereby yielding a blade member having a single-body structure and in which the density of the conducting filler is sufficiently low or substantially zero at one side. Alternatively, these two kinds of molding materials may be charged in layers into a press molding machine, thereby also yielding a blade member having a single-body structure and in which the density of the conducting filler is sufficiently low or substantially zero at one side.

In the blade member of the present invention the thickness of a portion of low conducting-filler density can be controlled by controlling, for example, the viscosity and setting speed of a polymeric base material, the affinity and the difference in specific gravity between the polymeric base material and a conducting filler, the granular size and shape of the conducting filler, or the kind and amount of the conducting filler, and, in the case of centrifugal molding, by controlling a centrifugal force generated through rotation of a drum.

In the blade member having such a structure, in order to enhance wear resistance and to prevent voltage leakage, a region containing substantially no insoluble conducting filler such as carbon is preferably formed at the surface which comes into contact with an electrophotosensitive member, such that the region has a thickness of 10–40 $\mu$m. The reason is that the electric resistance of the contacting portion as measured in the thickness direction (hereinafter may be referred to as the "thicknesswise resistance") depends on the thickness of the region containing substantially no insoluble conducting filler. The electric resistance of the opposite surface (i.e., the back surface) of the contacting portion in the thicknesswise direction depends on the amount of an insoluble conducting filler, such as carbon, dispersed in the back-side surface portion. The amounts of insoluble conducting filler in the front-side surface portion and the back-side surface portion can be regulated through modification of the amount and the grain size distribution of the conducting filler to be dispersed, as well as production conditions.

When a conducting filler having a broad grain size distribution is added the thickness of a surface layer containing substantially no conducting filler increases with the result that the electrical resistance of the surface layer becomes high. By contrast, when the same conducting filler having a narrow grain size distribution is added in the same amount the thickness of a surface layer containing substantially no conducting filler decreases with the result that the electrical resistance of the surface layer becomes low. Thus, the thickness and electric resistance of the surface layer containing no insoluble conducting filler is easily adjusted through adjustment of the mixing ratio of two conducting fillers having different grain size distributions.

In a conventional blade member, the electric resistance has been difficult to control since the resistance easily varies depending on the amount of a conducting filler incorporated into a base material. Furthermore, some conventional blade members are composed of a conductive base member and an insulating layer attached to the conductive base member; e.g., a blade in which an insulating layer is applied or bonded to the conductive base member. However, such application or bonding of an insulating layer makes the structure of the blade member more complex and increases the cost. In addition, the insulating layer may delaminate when the blade wears. A similar problem may occur when a conductive layer is attached to an insulating substrate through coating, application, or bonding.

The blade of the present invention is formed through bonding of a blade member to a holder made of metal, resin, etc. In this case, one widthwise end portion of the blade member is used as a free end portion, and the other widthwise end portion is bonded to the holder.

A conductive holder, preferably a metallic holder is employed as the above-described holder. Electrical conduction between the conductive blade member and a power source is preferably established via the holder. Since an adhesive for bonding the blade member to the holder is an insulating material a conductive paste is preferably applied to form a conductive layer for establishing electrical connection between the blade member and the holder. Alternatively, a conductive member such as conductive plate or conductive wire is provided in order to establish electrical connection between the blade member and the holder.

Figure 3:
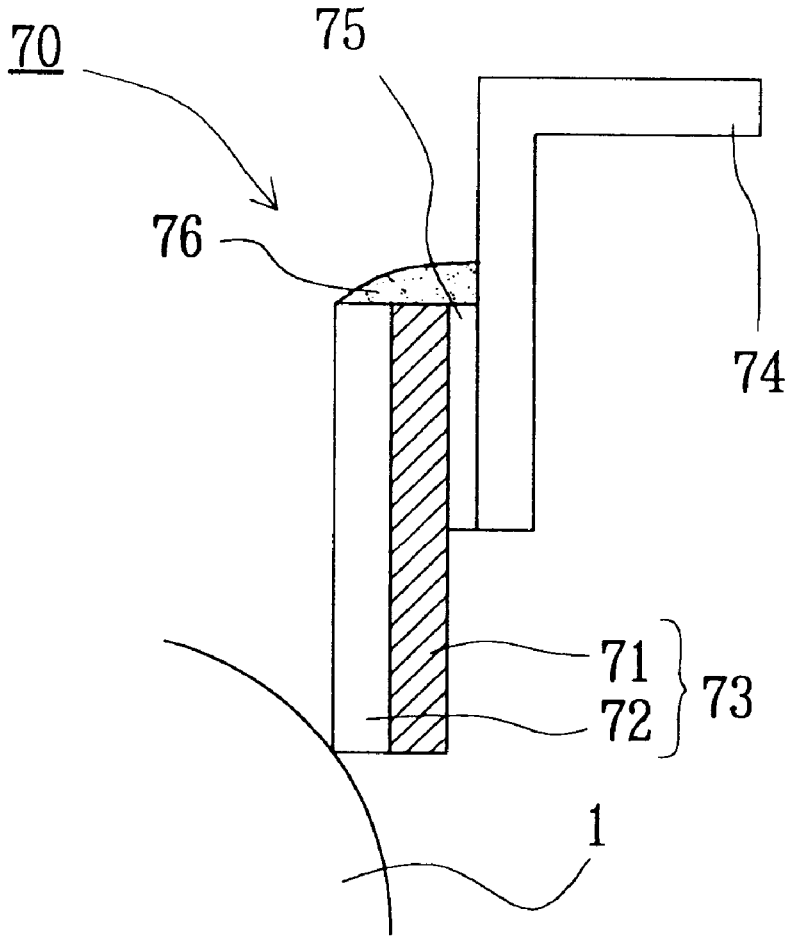
FIG. 3 is a sectional view showing an example of the blade of the present invention.

FIG. 3 shows a cross-sectional view of an example of the above-described conductive blade. The conductive blade 70 comprises a holder 74 and a rubber blade 73 which is composed of a conductive portion 71 and a nonconductive portion 72 integrally formed together. The rubber blade 73 is bonded to the holder 74 via an adhesive layer 75. The conductive paste layer of 76 is provided such that the conductive paste layer 76 extends in the longitudinal direction of the rubber blade 73 and covers one widthwise end portion of the rubber blade 73 opposite the widthwise end portion thereof which comes into contact with the electrophotosensitive member 1. The thus-provided conductive paste layer 76 establishes electrical conduction between the holder 74 and the conductive portion 71.

Figure 4:
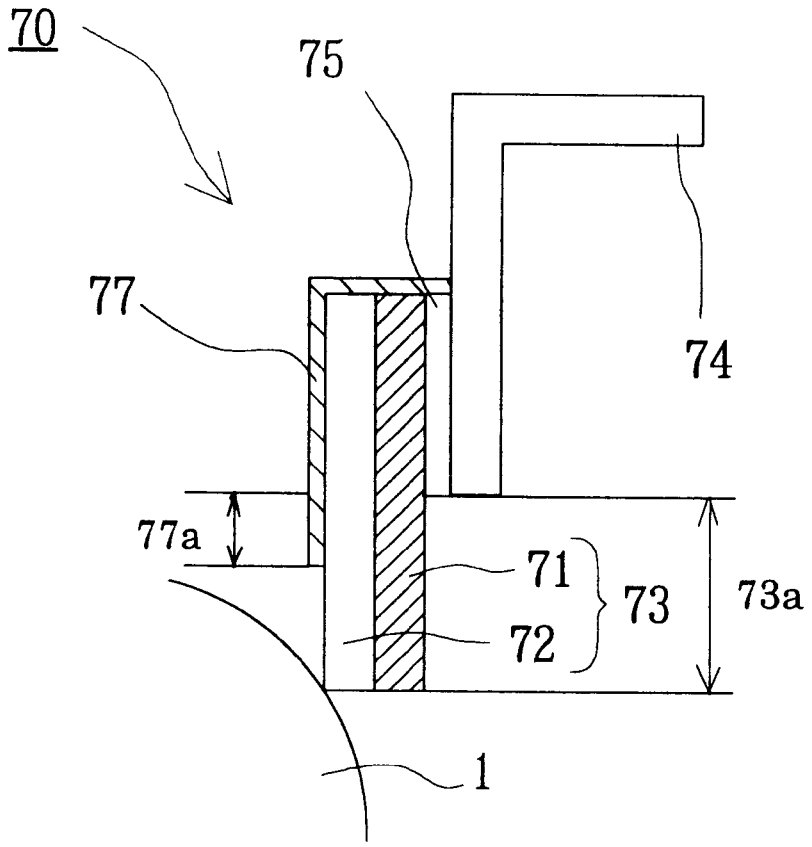
FIG. 4 is a sectional view showing an undesirable example of the blade of the present invention.

When electrical conduction is established between the blade member and the holder in the above-described manner it is undesirable to apply a conductive paste or dispose a conductive member in such a manner that the conductive paste or the conductive member extends to and covers the free end portion of the blade member which is not in contact with the holder. That is, as shown in FIG. 4, it is undesirable to provide a conductive paste or conductive member 77 in such a manner that the conductive paste or conductive member 77 extends to and enters the free end portion 73*a* of the rubber blade 73. If the conductive paste or conductive member 77 extends to and covers the free end portion 73*a* of the rubber blade 73, a portion 77*a* of the conductive paste or conductive member 77 which covers the free end portion 73*a* of the rubber blade 73 causes the tip of the rubber blade 73 to meander, or changes the pressure of contact of the rubber blade 73 with the electrophotosensitive member 1.

Accordingly, as shown in FIG. 3, it is preferred to establish electrical conduction at portions except the free end portion of the blade member. Specifically, the conductive paste layer is preferably provided between the holder and the widthwise end of the blade member opposite the free end portion thereof.

In the blade of the present invention, through provision of a conductive paste or blade, proper electrical conduction is established between a power source and the portion of the blade that comes into contact with a subject member. Therefore, the blade of the present invention can provide the excellent function of establishing charges on and eliminating charges from the subject member.

Figure 5:
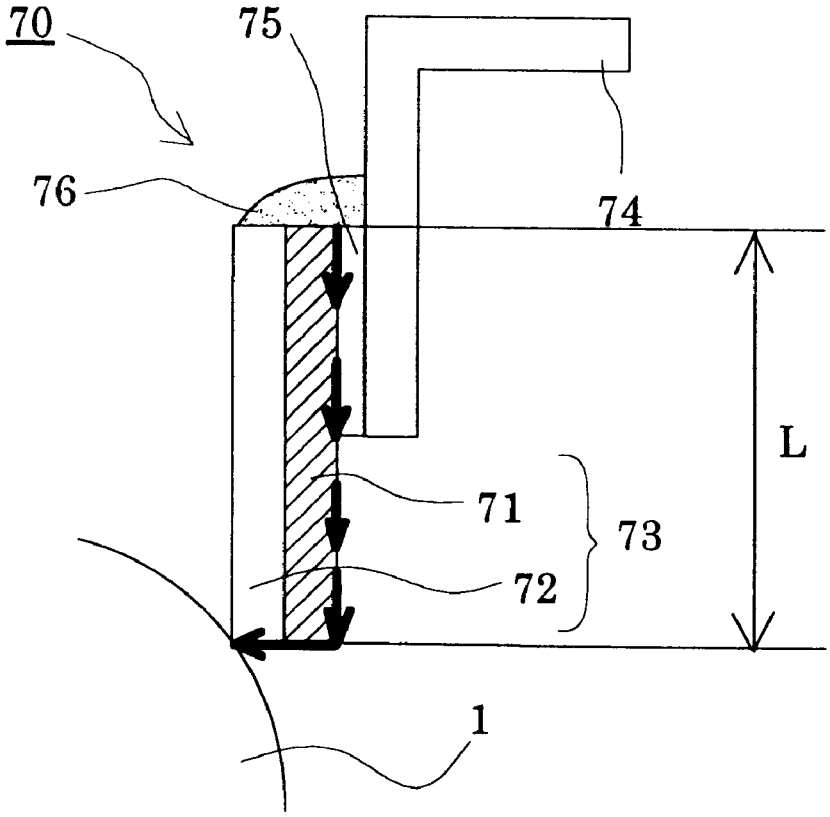
FIG. 5 is a sectional view showing a flow of current in the example of the blade of the present invention.

The present inventors investigated the relationship between the resistance of a blade and the charge establishing/eliminating performance in a printer having a process speed of 24 mm/s, and found that a blade of 2 mm thickness preferably has an electrical resistance of $1\times10^8$ Ωcm or less in order to function as a charge establishing means, and an electrical resistance of $5\times10^8$ Ωcm or less in order to function as a charge eliminating means. Since the electrical resistance of the portion of urethane not containing a conducting filler is $1\times10^{10}$ to $1\times10^{12}$ Ωcm, it is difficult to establish direct electrical conduction between the surface of the nonconductive portion and a subject member, while satisfying the above requirements in relation to electrical resistance. However, a satisfactory degree of electrical conduction can be established between the surface of the nonconductive portion and a subject member when electrical connection is established between the conductive portion and the holder, and the electrical resistance of the contacting portion as measured in the thicknesswise direction is made to fall within a predetermined range, such that current flows through a portion near the back surface of the rubber blade, which portion contains a large amount of an insoluble conducting filler and has a low electrical resistance. FIG. 5 shows such a flow of current I.

In view of the foregoing, the surface resistance of the conductive portion, especially the surface resistance at the back surface, is preferably set to $1\times10^7$ Ω□ or less. Further, it is important that the volume resistance ρv of one thicknesswise end portion of the blade member which comes into contact with the subject member and the surface resistance ρs of the opposite thicknesswise end portion of the blade member satisfy the relationship $\rho s\cdot L<\rho v\cdot d/L$, where L is the distance between the end where the conductive binder is applied and the end which comes into contact with the subject member (see FIG. 5), and d is the thickness of the blade member.

For example, when the thickness d of the blade member is 0.2 cm, and L=1.6 cm, the surface resistance of the back surface must be $1.1\times10^7$ Ω□ or less in order to allow the blade member to function as a charge establishing means or to make the thicknesswise resistance less than the above-described upper limit of $1.3\times10^8$ Ωcm. Similarly, the surface resistance of the back surface must be $6.3\times10^7$ Ω□ or less in order to allow the blade member to function as a charge eliminating means or to make the thicknesswise resistance less than the above-described upper limit of $5\times10^8$ Ωcm.

Meanwhile, the present inventors have found that the bonding strength between a blade member and a conductive holder (particularly a metal holder) disadvantageously decreases due to generation of rust. In order to prevent this problem in the present invention the adhesive layer between the blade member and the holder is subjected to waterproofing treatment. Any waterproofing treatment may be carried out so long as the treatment prevents invasion of moisture into the adhesive layer. Preferably, a hydrophobic coating material or paint is applied to provide waterproofing.

Figure 6:
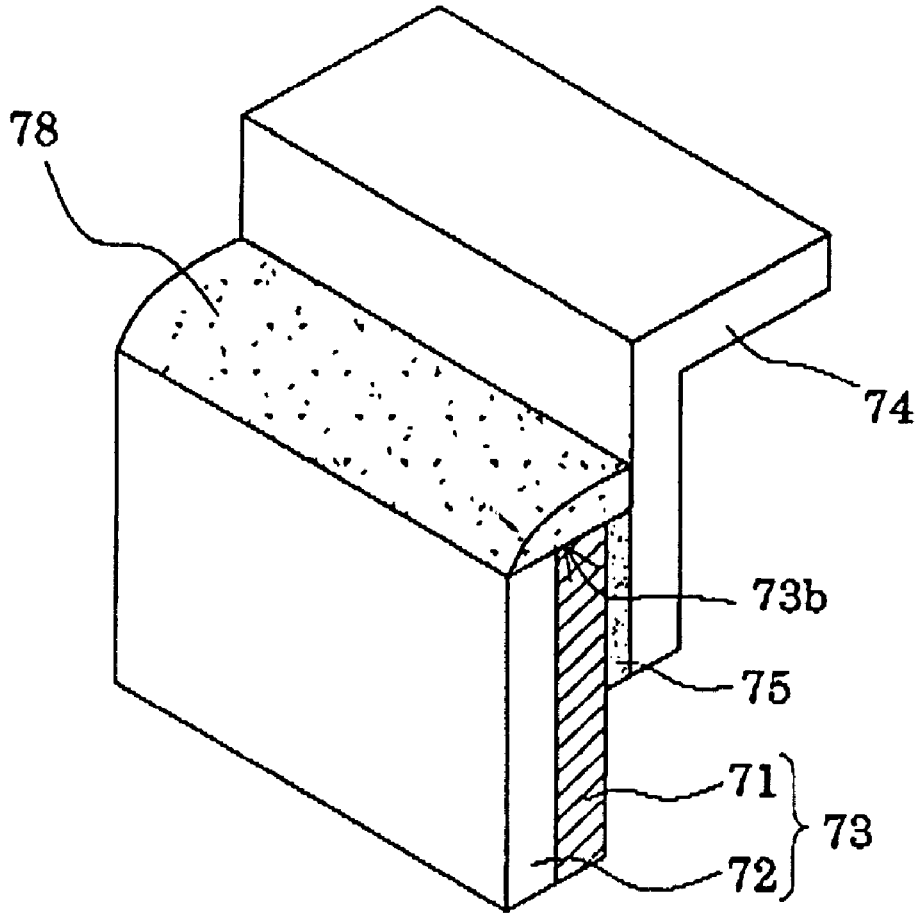
FIG. 6 is a perspective view showing the example of the blade of the present invention.

Particularly, when a hydrophilic adhesive such as a primer comprising a silane coupling agent is applied to the holder, and the blade member is subsequently bonded to the holder via the primer in a hot-melt manner, moisture easily invades through the hydrophilic adhesive resulting in the generation of rust. In such a case the end portion of the hydrophilic adhesive layer exposed to the air is coated with a hydrophobic coating material. Since the largest force acts on the widthwise end portion of the blade member opposite to the contacting portion thereof which comes into contact with a subjective member, the hydrophobic coating material or paint is preferably applied to cover that widthwise end portion. An example of such a blade is shown in FIG. 6. In this case, the largest force acts on the upper end portion 73(*b*) of the blade member 73, and therefore, a hydrophobic coating material (or paint) 78 is applied to cover the upper end portion 73(*b*).

Rust generation is accelerated when an ion-conductive filler such as lithium perchlorate is incorporated as a conducting filler into a base material of the blade member in addition to an insoluble conducting filler such as carbon black. In this case, the ion-conductive filler may partially leak from the blade member and reach the holder through the adhesive layer and thereby accelerate generation of rust. In order to prevent the generation of rust a layer for intercepting ions is preferably provided between the blade member and the holder. For example, a material having affinity to both the holder and the adhesive is employed as an ion-intercepting layer and applied to the holder. Examples of materials suitable for the ion-intercepting layer include epoxy resins and acrylic resins.

When a blade member containing an ion-conductive filler is bonded to a holder via an ion-intercepting layer and a hydrophobic coating material is applied to the bonding portion as described above the bonding strength is effectively maintained.

If a conductive paste comprising a hydrophobic resin in which a conducting filler such as carbon black is dispersed is used instead of a hydrophobic coating material both conductivity and waterproofing are provided.

The blade of the present invention abuts a subject member, such as an electrophotosensitive member, for smoothing charges on, eliminating charges from, or establishing charges on the subject member.

Figure 7A:
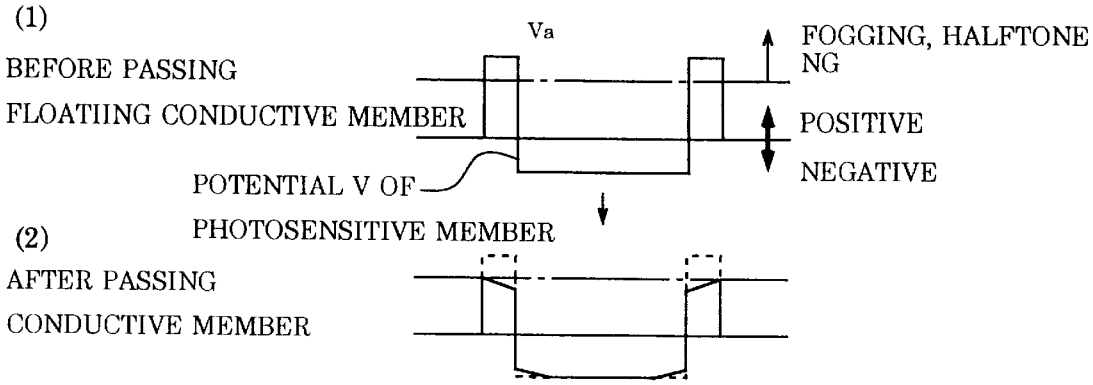
FIG. 7A–FIG. 7C are views for explaining the function of the blade of the present invention.
Figure 7B:
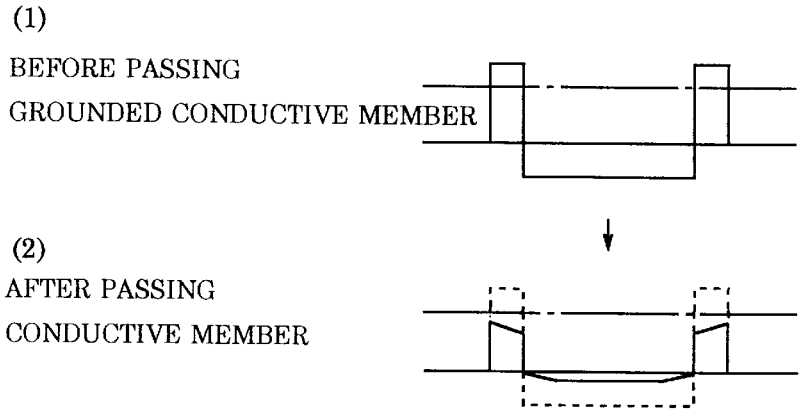

The above functions of the blade member will next be described with reference to FIGS. 7A–7C, in which an electrophotosensitive member is the subject member. When the blade of the present invention in an electrically floating state is brought into contact with the electrophotosensitive member having a surface portion on which charges are established in an extremely different state as compared to the surrounding surface portion, the blade functions so as to smooth out the differently established charges. For example, in the case of reverse development in which primary charging is performed by means of negative charges, when positive charges are excessively established through transfer, a state shown in FIG. 7A(1) is established. Specifically, positive charges are established on a surface portion of the electrophotosensitive member corresponding to the exterior side of a transfer medium. Negative charges are established on a surface portion of the electrophotosensitive member corresponding to the interior side of the transfer medium. Surface potential V of the electrophotosensitive member includes a potential step Va corresponding to an end portion of the transfer medium. In subsequent primary charging the electric potential of the surface portion carrying positive charges cannot increase to a predetermined level causing attraction of unnecessary toner onto the electrophotosensitive member, fogging, or uneven image density with respect to halftone. However, as shown in FIG. 7A(2), as a result of the electrically floating blade member abutting the electrophotosensitive member, charges are smoothed out on the surface portions carrying positive and negative charges.

When the electrically grounded blade member is brought into contact with the electrophotosensitive member charges on the electrophotosensitive member are caused to move toward the ground (equivalent to elimination of charges), thereby smoothing out charges and causing the surface voltage v of the electrophotosensitive member to approach 0 V. As described above in the case of reverse development in which primary charging is performed by means of negative charges when positive charges are established on the electrophotosensitive member through transfer (FIG. 7B(1)), charges can be smoothed out (FIG. 7B(2)), thereby relaxing fogging and attraction of unnecessary toner onto the electrophotosensitive member.

Figure 7C:
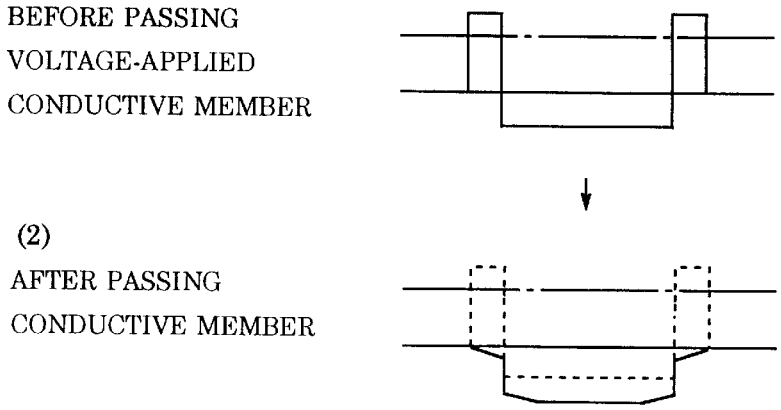

When the blade of the present invention connected to a voltage source (high-voltage transformer) is brought into contact with the electrophotosensitive member (FIG. 7C(1)), charges can be eliminated from the electrophotosensitive member more reliably (FIG. 7C(2)) than in the above-described methods thereby preventing fogging and attraction of unnecessary toner onto the electrophotosensitive member.

That is, in terms of a capability of smoothing charges on and eliminating charges from the electrophotosensitive member by means of the blade member the method in which voltage is applied to the blade member is most effective; the method in which the blade member is grounded is next most effective; and the method in which the blade member is floated is least effective. These methods may be selected according to application.

In the case where voltage is applied to the blade, the blade can be used as a primary charging means. In the case where dc voltage is applied to the blade in order to generate a surface voltage $V_0$. on a subject member, such as an electrophotosensitive member, $V_0$ plus charging starting voltage may be applied. In the case where ac voltage is to be superposed on dc voltage for application to the blade the dc voltage may assume $V_0$ and the ac voltage may assume a peak-to-peak value that is at least double the charging starting voltage.

A subject member is not limited to an electrophotosensitive member, but may be any member whose charges are to be smoothed or that is to be charged.

For example, the blade may be used for smoothing charges on, eliminating charges from, or establishing charges on a transfer belt or intermediate transfer member, which abuts an electrophotosensitive member via a transfer medium, such as paper. Alternatively, the blade may abut an electrophotosensitive member while a transfer medium extends between the blade and the electrophotosensitive member, thereby transferring toner from the electrophotosensitive member to the transfer medium.

Figure 8A:
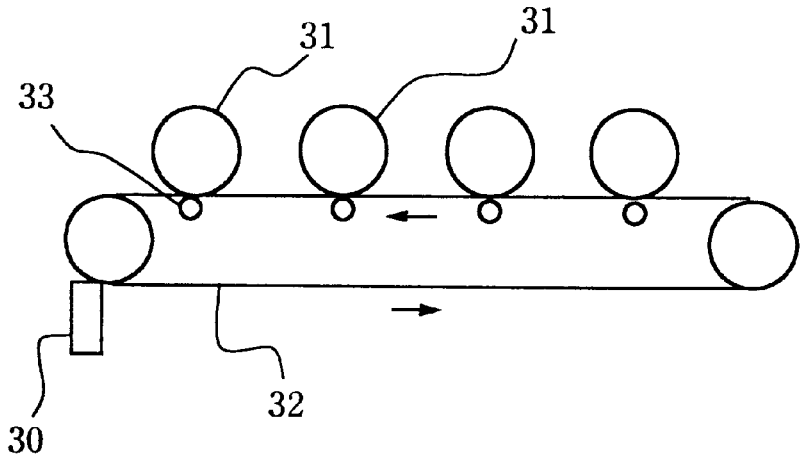
FIG. 8A is a view showing a mode for using the blade of the present invention.
Figure 8B:
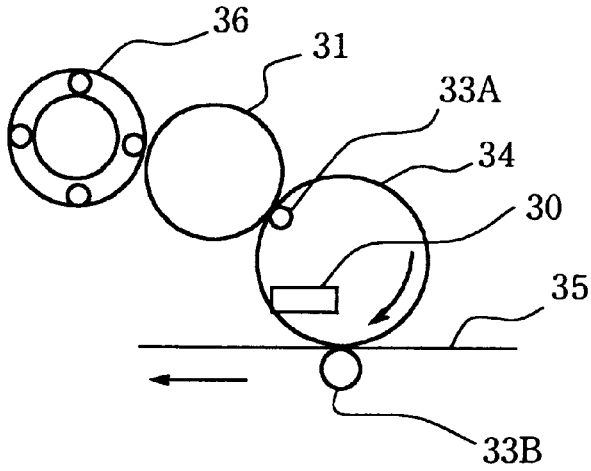
FIG. 8B is a view showing another mode for using the blade of the present invention.
Figure 8C:
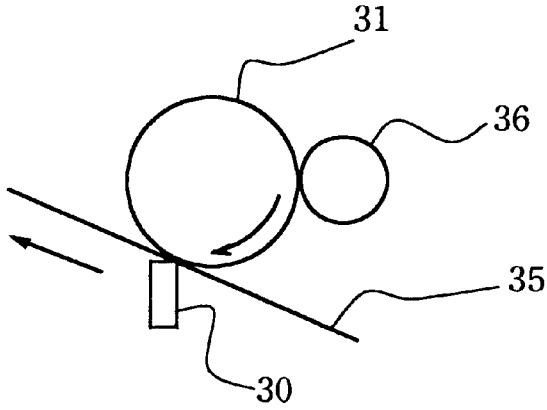
FIG. 8C is a view showing still another mode for using the blade of the present invention.

FIGS. 8A–8C depict modes for using the blade. In FIG. 8A, a plurality of electrophotosensitive members 31 are disposed in contact with a transfer belt 32, which is rotatively driven. Transfer rollers 33 are disposed in opposition to the corresponding electrophotosensitive members 31, while the transfer belt 32 is interposed therebetween. A blade 30 of the present invention is disposed in contact with the transfer belt 32.

In FIG. 8B, an intermediate transfer member 34 is disposed in contact with an electrophotosensitive member 31 while being interposed between the electrophotosensitive member 31 and a transfer roller 33A. A transfer roller 33B causes a transfer medium 35 to abut the intermediate transfer member 34. An image formed by a developing unit 36 is transferred to the transfer medium 35 via the intermediate transfer member 34. A blade 30 of the present invention is disposed in contact with the inner surface of the intermediate transfer member 34.

In FIG. 8C, a transfer medium 35 is in direct contact with an electrophotosensitive member 31 to thereby transfer to a transfer medium 35 an image formed by a developing unit 36. A blade 30 of the present invention abuts the transfer medium 35 from opposite the electrophotosensitive member 31.

Figure 9:
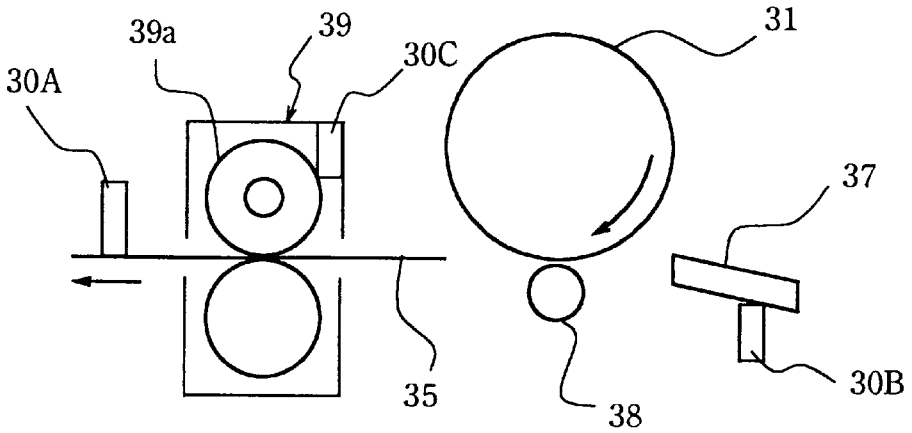
FIG. 9 is a view showing a further mode for using the blade of the present invention.

FIG. 9 depicts a still further mode for using the blade. Being fed via transfer medium transport means 37, a transfer medium 35 is transported while passing between an electrophotosensitive member 31 and a transfer medium roller 38. Then, the transfer medium 35 is transported while passing between a pair of fixing rollers **39*a* of fixing means 39. The blade of the present invention may be disposed in contact with the transfer medium 35 (blade 30A), the transfer medium transport means 37 (blade 30B), or the fixing roller 39***a* (blade 30C). In any of these cases charges can be smoothed, eliminated, or established.

Figure 10:
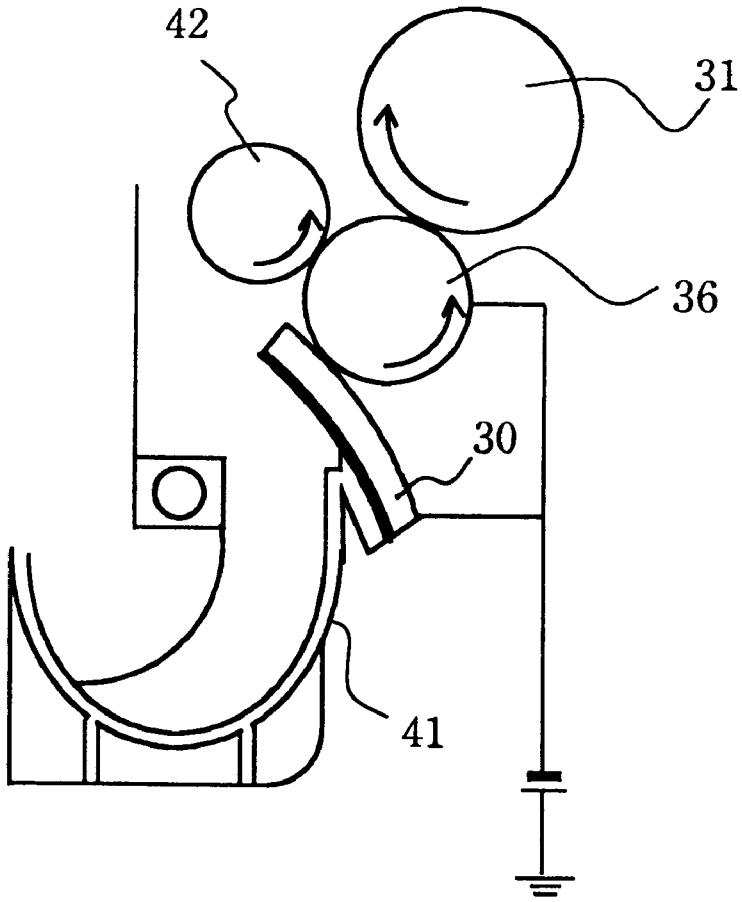
FIG. 10 is a view showing a still further mode for using the blade of the present invention.

FIG. 10 depicts a still further mode for using the blade. The blade is used as a developing blade in a single-component developing system. A developing unit 36 is disposed in contact with a toner feed roll 42, which is disposed within a toner container 41. An electrophotosensitive member 31 is disposed in contact with the developing unit 36. A blade 30 is disposed in contact with an outlet portion of the toner container 41 and is used as a developing blade for controlling the thickness of a toner layer formed on the developing unit 36. Bias identical to developing bias (negative, for example) is applied to the blade 30, thereby preventing attraction of toner of reverse polarity to the developing unit 36. Further, the portion of the conducting member 30 that slides on the developing unit 36 contains a conducting filler at sufficiently low density or contains no conducting filler, thereby preventing voltage leakage to any scratch present on the developing unit 36 and exhibiting excellent durability.

When the blade of the present invention is to be used as a cleaner the contact force must be increased in order to clean off remaining toner from an electrophotosensitive member. Thus, the blade must possess endurance to wear. According to the present invention, a portion of low conducting-filler density abuts the electrophotosensitive member, thereby utilizing endurance to wear possessed by a polymeric base material, such as polyurethane. A conventional blade composed of a blade-shaped base and an insulating layer bonded to the base involves a drawback in that the insulating layer tends to come off due to friction between the electrophotosensitive member and the blade. Further, the manufacturing process becomes complicated. The present invention is advantageous in this regard, since a single-body structure is employed.

EXAMPLES

The present invention will next be described in detail by way of example, which should not be construed as limiting the invention.

Example 1

Polyester polyol (PCL 220N: P-2010=67: 26.6) (103.6 parts by weight) was melted through application of heat. Into the melt, carbon black (TOKA BLACK #5500 (trade name, product of Tokai Carbon Co., Ltd.)) (1.4 parts by weight) and lithium perchlorate (0.5 parts by weight) serving as an ion-conductive filler were dispersed. 4,4-Diphenyl methane diisocyanate (MDI) was reacted with the resulting mixture, yielding a prepolymer. 1,4-Butanediol and trimethylolpropane were mixed, in the ratios shown below, with the prepolymer. The resulting mixture was charged into a preheated centrifugal molding drum and was then cured through application of heat while the drum was being rotated at high speed (centrifugal force: 360 G).

The thus-molded sheets were cut into rubber blades of predetermined dimensions. The rubber blades were bonded to the respective metallic holders. After an adhesive was cured, electrical connection was established between the rubber blades and holders by use of a conductive carbon paste, yielding conductive blades.

Herein, Polyol PCL 220N is a trade name of polyester polyol (Mn=2000) produced by Daicel Chemical Industries, Ltd.; and P-2010 is a trade name of ester polyol (Mn=2000) produced by Kuraray Co., Ltd.

The thus-obtained conductive blades have a structure shown in FIG. 3. The conductive blade 70 comprises a holder 74 and a rubber blade 73 which is composed of a conductive portion 71 and a nonconductive portion 72 integrally formed together. The rubber blade 73 is bonded to the holder 74 via an adhesive layer 75. A layer of 76 is provided such that the conductive paste layer 76 extends in the longitudinal direction of the rubber blade 73 and covers one widthwise end portion of the rubber blade 73 opposite the widthwise end portion thereof which comes into contact with the electrophotosensitive member 1. The conductive paste 76, comprising a hydrophobic resin incorporated with carbon black, also provides waterproofing.

Both longitudinal end surfaces of the rubber blade 73 are preferably coated with the conductive paste 76 in view of waterproofing treatment. Although the end surfaces of the nonconductive portion 72 may similarly be coated, it is undesirable to apply the conductive paste 76 such that the layer of the conductive paste extends from the portion bonded to the holder 74 to enter and cover the free end portion. In addition, a layer of a conductive paste for establishing electrical connection and a film for waterproofing may be provided separately. For example, a conductive paste may be applied partially or over the entire length, and the thus-formed conductive paste layer may be subjected to waterproofing.

The thus-provided conductive paste 76 establishes electrical connection between the holder 74 and the conductive portion 71. Accordingly, the current can flow from the holder 74 to a portion in the vicinity of the electrophotosensitive member 1, and further reaches the electrophotosensitive member 1 in the thicknesswise direction.

Example 2

The same procedure as that used in Example 1 was repeated except that carbon black having another grain size distribution was used to produce blades.

Test Example

The thickness of the nonconductive layer containing no carbon black and the electric resistance of the surface were measured for samples of the blades produced in Examples 1 and 2. The results are shown in Table 1. The data on the grain sizes of carbon black employed in Examples 1 and 2 are also shown in Table 1.

TABLE 1

| | | Example 1 | Example 2 |
|---|---|---|---|
| Electrical resistance | Ω | $1.0 \times 10^7$ | $1.0 \times 10^8$ |
| Surface layer thickness | μm | 5–15 | 40–50 |
| Carbon black | | | |
| Median size | μm | 0.443 | 0.609 |
| Specific surface area | $cm^2/cm^3$ | 141442 | 110311 |
| Grain size % (1.00 μm) | % | 94.0 | 70.2 |
| % Grain size (99%) | μm | 1.541 | 5.617 |
| Minimum grain size | μm | 0.131 | 0.131 |
| Maximum grain size | μm | 2.268 | 8.815 |

The results indicate that when carbon black having a broad grain size distribution is used the thickness of the surface layer increases so that the surface resistance of the blade increases.

What is claimed is:

1. A blade comprising:

a blade member having a first widthwise end portion for bringing into sliding contact with a subject member; and a holder bonded to a second widthwise end portion of the blade member opposite said first widthwise end portion via an adhesive layer and extending in a longitudinal direction of the blade member, wherein at least a portion of an externally exposed end surface of the adhesive layer is subjected to waterproofing treatment so as to prevent bonding strength from decreasing.

2. A blade according to claim 1, wherein the second widthwise end portion of the blade member which comes into contact with the subject member is subjected to waterproofing treatment.

3. A blade according to claim 1, wherein the waterproofing treatment is application of a hydrophobic paint.

4. A blade according to claim 1, wherein at least a portion of the adhesive used for bonding the blade member to the holder is hydrophilic.

5. A blade according to claim 1, wherein the blade member has electrical conductivity, and comprises a base material and an insoluble conducting filler dispersed in the base material, the insoluble conducting filler being selected from the group consisting of carbon black and metal powder.

6. A blade according to claim 5, wherein the blade member further contains an ion-conductive filler.

7. A blade according to claim 5, wherein the blade member is formed in a single body by use of the base material; a first thicknesswise end portion of the blade member, which comes into contact with the subject member, does not substantially contain the insoluble conducting filler; and a second thicknesswise end portion of the blade member opposite the first thicknesswise end portion contains the insoluble conducting filler.

8. A blade according to claim 5, wherein a conductive binder containing at least a hydrophobic binder and an insoluble conducting filler dispersed therein is applied such that connection is established between the holder and at least a portion of the second widthwise end portion of the blade member.

9. A blade according to claim 8, wherein the volume resistance $\rho v$ of a first thicknesswise end portion of the blade member, which comes into contact with the subject member, and the surface resistance $\rho s$ of a second thickness wise end of the blade member opposite the first thicknesswise end portion satisfy the relationship $\rho s \cdot L < \rho v \cdot d/L$, where L is the distance between the end where the conductive binder is applied and the end which comes into contact with the subject member, and d is the thickness of the blade member.

10. A blade according to any one of claim 9, wherein the surface resistance of the second thicknesswise end portion of the blade member is adjusted through adjustment of grain size distribution of the insoluble conducting filler contained in the blade member.

11. A blade according to claim 9, wherein the surface resistance of the second thicknesswise end portion of the blade member is $10^7$ Ω□ or less.

12. A blade according to claim 1, wherein the blade member is formed of an insulating or semi-conductive polymeric base material.

13. A blade according to claim 1, wherein the blade contains an ion-conductive filler, and a layer for intercepting ions is provided between the blade member and the holder.

14. A blade which comprises a blade member having a first widthwise end portion for bringing into sliding contact with a subject member; and a holder bonded to a second widthwise end portion of the blade member opposite said first widthwise end portion via an adhesive layer and extending in a longitudinal direction of the blade member, wherein the blade contains an ion-conductive filler; and a layer for intercepting ions is provided between the blade member and the holder.

15. A blade comprising:

a blade member having a first widthwise end portion for bringing into sliding contact with a subject member; and a holder bonded to a second widthwise end portion of the blade member opposite said first widthwise end portion via an adhesive layer and extending in the longitudinal direction of the blade member, wherein at least a portion of an externally exposed end surface of the adhesive layer is subjected to waterproofing treatment so that bonding strength is prevented from decreasing, the widthwise end portion of the blade member opposite the widthwise end portion which comes into contact with the subject member is subjected to waterproofing treatment, the waterproofing treatment is application of a hydrophobic paint, and at least a portion of the adhesive used for bonding the blade member to the holder is hydrophilic.

16. A blade comprising:

a blade member having a first widthwise end portion for bringing into sliding contact with a subject member; and a holder bonded to a second widthwise end portion of the blade member opposite said first widthwise end portion via an adhesive layer and extending in the longitudinal direction of the blade member, wherein at least a portion of an externally exposed end surface of the adhesive layer is subjected to waterproofing treatment so that bonding strength is prevented from decreasing, the blade member has electrical conductivity, and comprises a base material and an insoluble conducting filler dispersed in the base material, the insoluble conducting filler being selected from the group consisting of carbon black and metal powder, the blade member further contains an ion-conductive filler, the blade member is formed in a single body by use of the base material; a first thicknesswise end portion of the blade member, which comes into contact with the subject member, does not substantially contain the insoluble conducting filler; and a second thicknesswise end portion of the blade member opposite the first thicknesswise end portion contains the insoluble conducting filler, and a conductive binder containing at least a hydrophobic binder and an insoluble conducting filler dispersed therein is applied such that connection is established between the holder and at least a portion of the second widthwise end portion of the blade member.

* * * * *